US005933959A

United States Patent [19]

Sferruzza, Jr.

[11] Patent Number: 5,933,959

[45] Date of Patent: Aug. 10, 1999

[54] SHAVING DEVICE

[76] Inventor: Gerald A. Sferruzza, Jr., 9 Cherry St., Lakeville, Mass. 02364

[21] Appl. No.: 08/800,778

[22] Filed: Feb. 14, 1997

[51] Int. Cl.[6] ..... B26B 21/22

[52] U.S. Cl. ..... 30/34.2; 30/47; 30/50

[58] Field of Search ..... 30/47, 50, 51, 30/81, 34.2

[56] References Cited

U.S. PATENT DOCUMENTS

| | | | |
|---|---|---|---|
| 3,722,090 | 3/1973 | Dawidowicz | 30/34.2 |
| 3,724,070 | 4/1973 | Dorion, Jr. | 30/50 |
| 3,777,396 | 12/1973 | Simonetti | 30/47 |
| 4,501,067 | 2/1985 | Duncan | 30/47 |
| 4,574,476 | 3/1986 | Ortiz | 30/47 |
| 4,641,429 | 2/1987 | Abatemarco | 30/50 |
| 4,693,003 | 9/1987 | Ferraro | 30/50 |
| 4,854,043 | 8/1989 | Chen | 30/50 |
| 5,412,872 | 5/1995 | Iderosa | 30/50 |
| 5,501,014 | 3/1996 | Hegemann | 30/50 |

*Primary Examiner*—Hwei-Siu Payer
*Attorney, Agent, or Firm*—Steven N. Fox, Esq.

[57] ABSTRACT

The present invention is an improved device for shaving the skin of a person. In one embodiment, the shaving device comprises a handle member having a lower portion and an upper portion. The shaving device further comprises a lower body member engaged with the upper portion of the handle member. The lower body member comprising a cavity portion and a radial shaped leading surface. The shaving device further comprises a razor blade disposed within the cavity portion and having a cutting edge. The shaving device further comprises an upper body member having a lower mounting portion and a radial shaped trailing surface. The lower mounting portion is adapted to secure the razor blade within the cavity portion. The trailing surface and the leading surface are disposed radially outward of said cutting edge. The shaving device further comprises a recess portion separating the leading surface and the trailing surface and providing access to the cutting edge of said razor blade. In operation, the leading surface and the trailing surface absorb any forces applied to the device by the person causing the skin to stretch and bulge into the recess portion and to thereby come in contact with the cutting edge of the razor blade. Any forces applied by the person are transmitted to the cutting edge of the razor thereby avoiding nicking and cutting of the skin.

8 Claims, 7 Drawing Sheets

SHAVING DEVICE

FIELD OF THE INVENTION

The present invention relates generally to shaving devices. More particularly, the present invention relates to shaving devices utilizing a razor blade.

BACKGROUND OF THE INVENTION

Various devices for removing hair from the human body have been developed. Such devices include electric razors and hand-held devices incorporating a razor blade. It is well known that devices utilizing a razor blade have traditionally provided a closer shave than non-razor devices such as electric razors. Shaving devices utilizing a razor blade have numerous drawbacks. Applied pressure by the user is transmitted directly to the razor and therefore the skin thereby creating a situation wherein nicking or cutting of the person's skin if often a consequence. Further, with such conventional devices the pressure contact by the razor blade upon the skin causes in some cases irritation of the person's skin. Additionally, applied pressure by the user directly to the razor bade causes increased friction which tends to dull the cutting edge of the blade in a shorter period of time thereby requiring the user to replace with the razor blade with a new one.

One object of the present invention is to provide a shaving device utilizing a razor blade which substantially prevents the razor blade from nicking the person's skin or causing irritation.

Another object of the present invention is to provide a shaving device wherein friction upon the cutting edge of the razor blade is reduced thereby resulting in a razor blade which will have a longer life.

SUMMARY OF THE PRESENT INVENTION

The present invention is a device for shaving the skin of a person. In one embodiment, the shaving device comprises a handle member having a lower portion and an upper portion. The shaving device further comprises a lower body member engaged with the upper portion of the handle member. The lower body member comprises a cavity portion and a radial shaped leading surface. The shaving device further comprises a razor blade disposed within the cavity portion and having a cutting edge disposed below the leading surface. The shaving device further comprises an upper body member having a generally radial shaped upper trailing surface. The upper body portion is adapted to secure engage the razor blade within the cavity portion such that the upper trailing surface is disposed above the cutting edge of the razor blade. The device further comprises a recess portion separating the leading surface and the trailing surface and allowing access to the cutting edge of said razor blade. In operation, the leading and trailing surface prevent the forces or pressure applied to cutting edge of the razor blade by the consumer from nicking or cutting the skin. The leading surface and the trailing surface absorb any forces applied to the handle member by the person causing the skin to stretch and bulge into the recess portion and to come in contact with the cutting edge of the razor blade. The skin being pliable and having memory stretches and gently protrudes (bulges) into the recess portion which is lower than the trailing surface and the leading surface and precisely pre-aligns itself to the cutting edge of the razor blade and also prevents the skin from passing under the razor blade.

BRIEF DESCRIPTION OF THE DRAWINGS

The following detailed description of the present invention will be more fully understood with reference to the accompanying drawings in which.

DETAILED DESCRIPTION OF THE PREFERRED EMBODIMENTS

Figure 1:
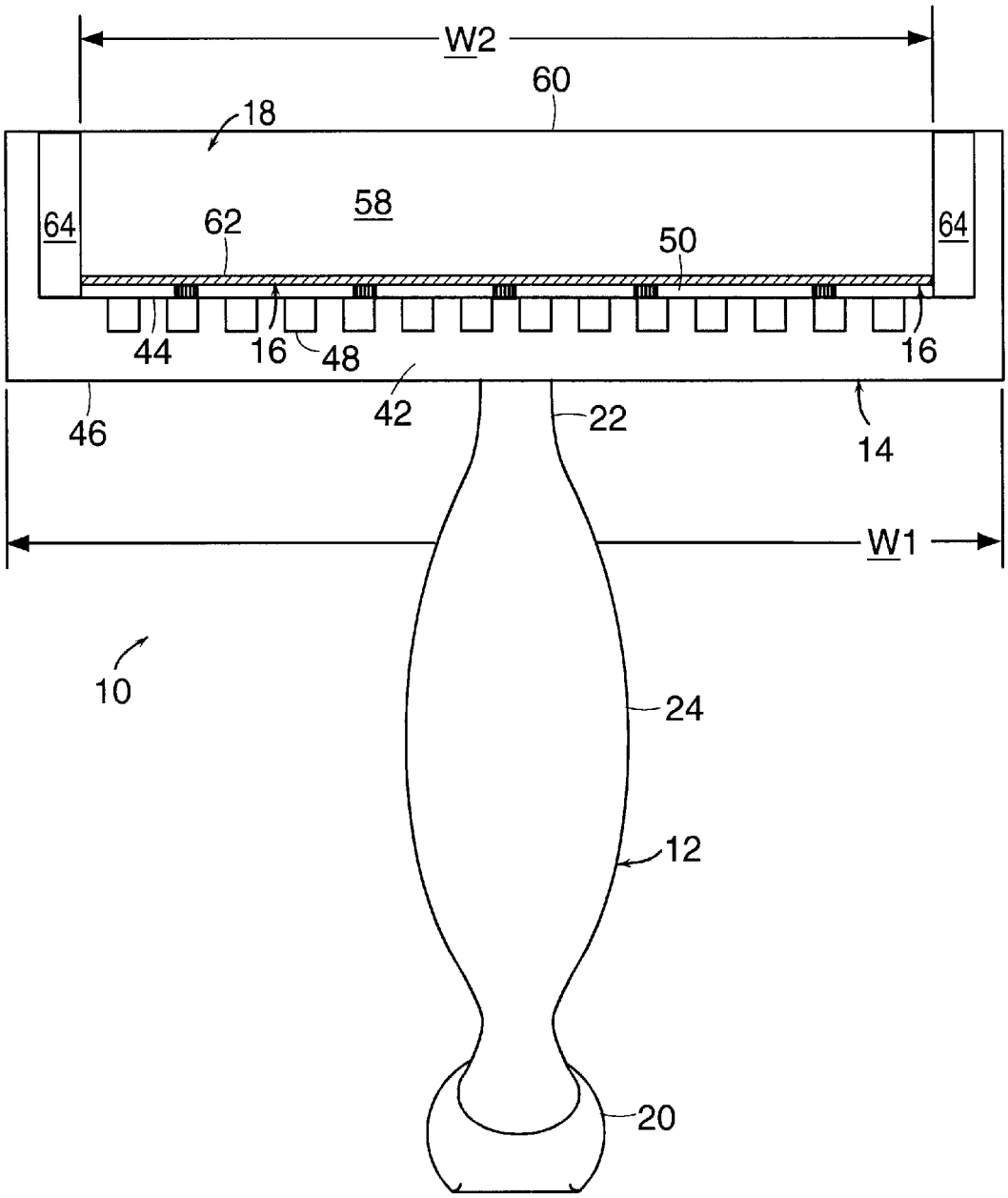
FIG. 1 is an front assembly view of a first embodiment of the shaving device of the present invention.
Figure 2:
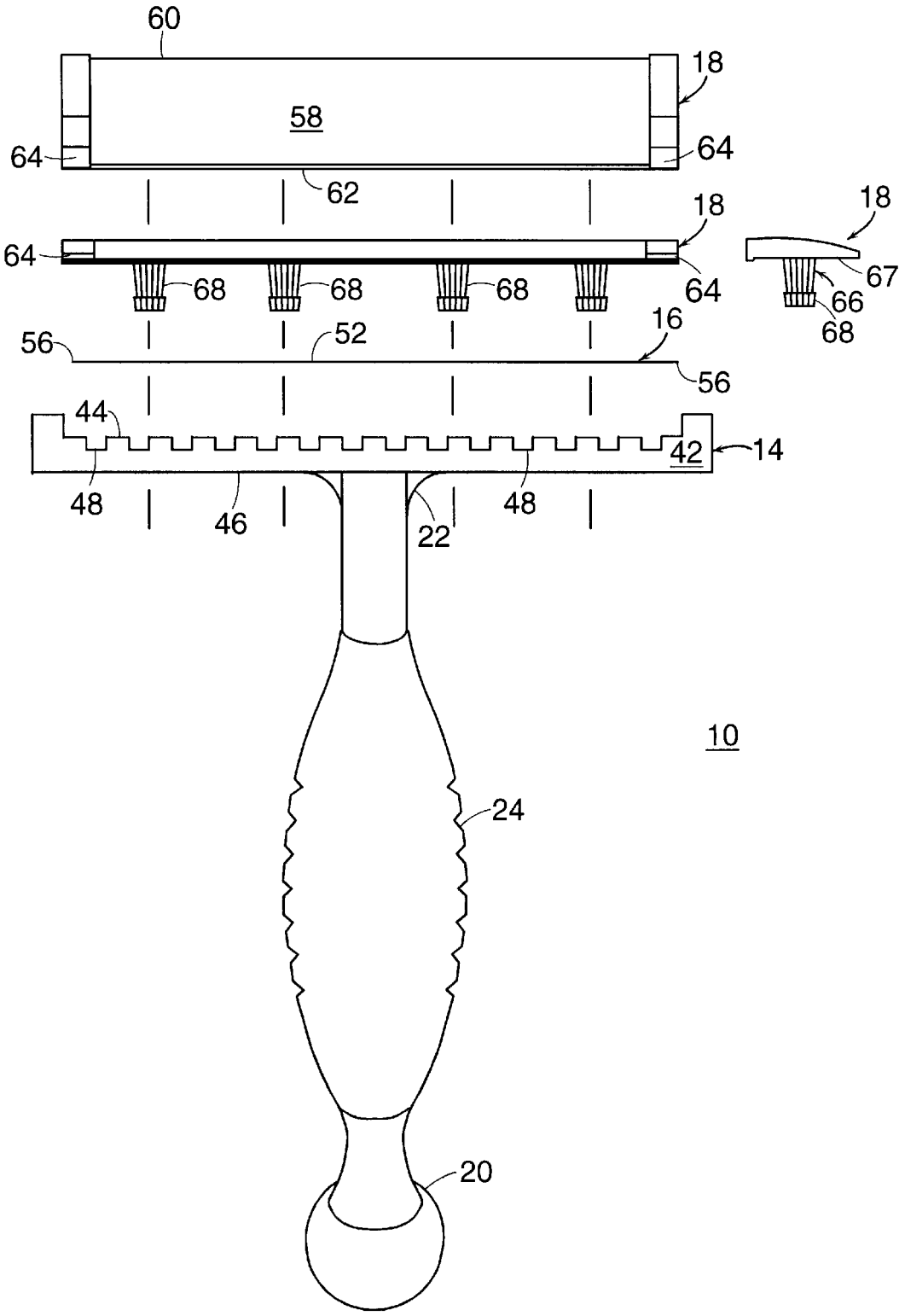
FIG. 2 is an exploded view of the first embodiment of the shaving device.
Figure 3:
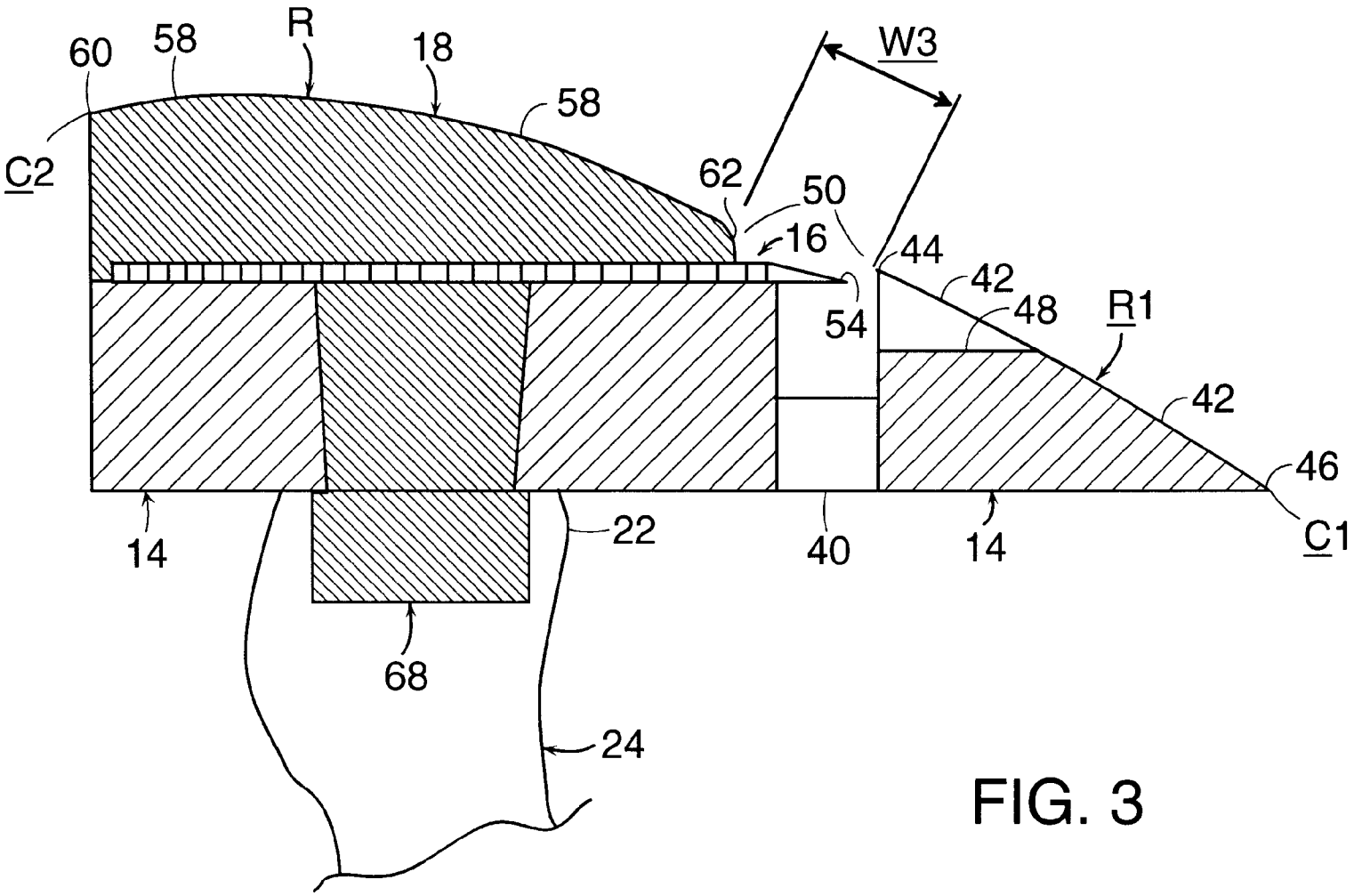
FIG. 3 is an assembled side cross section view of the first embodiment of the shaving device.
Figure 4:
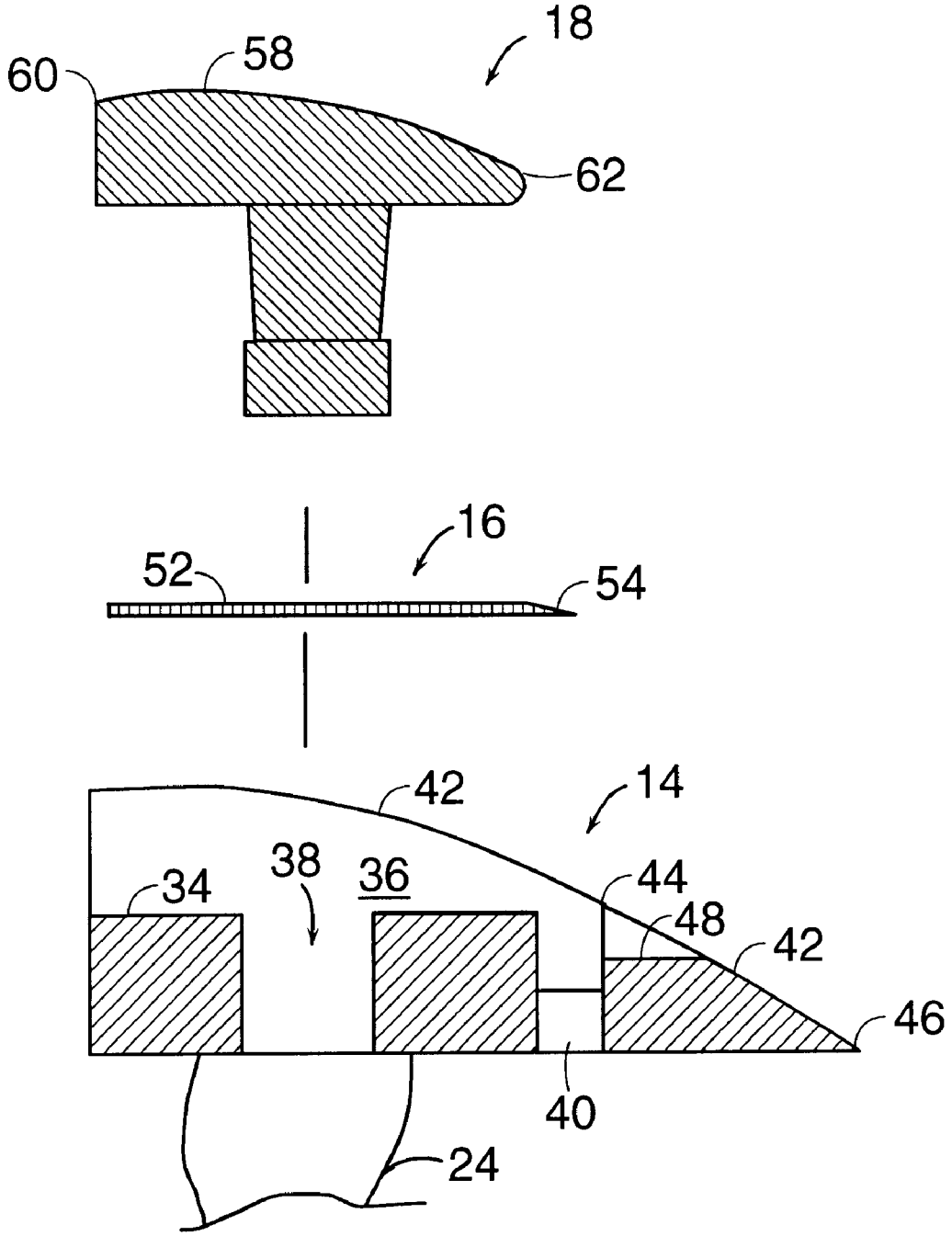
FIG. 4 is an exploded side cross section view of the first embodiment of the shaving device.

Referring to FIGS. 1–4, wherein the shaving device 10 is shown generally comprising a handle portion 12, a lower body portion 14, a razor blade 16, and an upper body portion 18.

The handle portion 12 generally comprises a lower portion 20 and an upper portion 22. The handle portion 12 further comprises a gripping portion 24 comfortably designed so that user may grasp and hold the shaving device 10 without slipping when the shaving device 10 becomes wet. As will be described more fully herein, the upper portion 22 is removably and securely connected to the lower body portion 14. Alternatively, the upper portion 22 is permanently and securely connected to the lower body portion 14.

Figure 5:
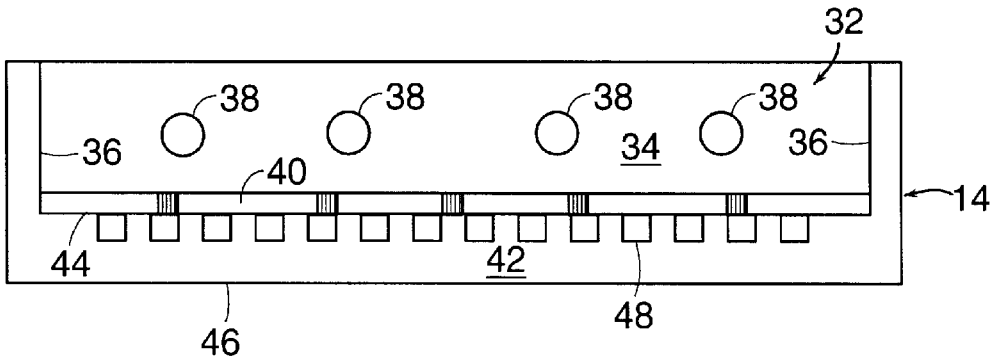
FIG. 5 is top plan view of the lower body portion of the first embodiment.
Figure 6:
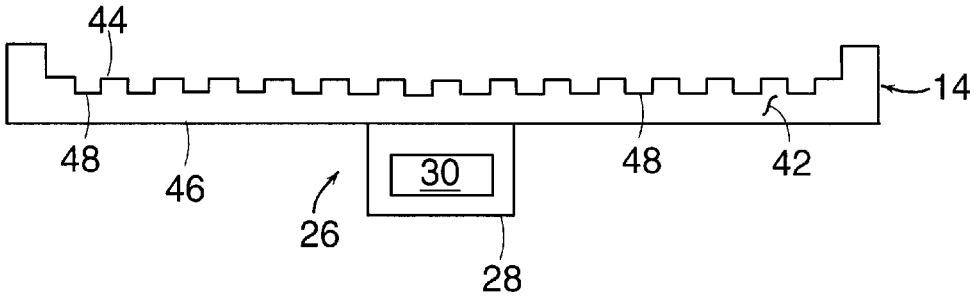
FIG. 6 is front elevation view of the lower body portion of the first embodiment.
Figure 7:
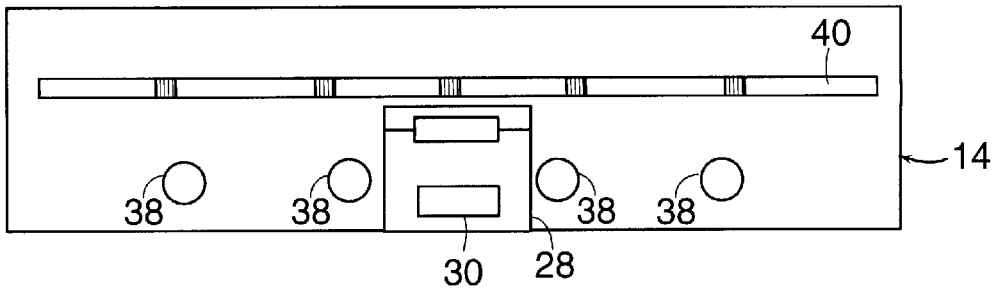
FIG. 7 is bottom plan view of the lower body portion of the first embodiment.

Referring to FIGS. 1–4 and 5–7, the lower body portion 14 generally comprises a lower mounting portion 26 having a protrusion 28 and a mounting channel 30 formed therein. The upper portion 22 of the handle 12 is adapted to securely mate with the channel 30 to thereby removably secure the handle portion 12 to the lower body portion 14. The lower body portion 14 further comprises a cavity portion 32 having a substantially planar mounting surface 34, end walls 36, mounting holes 38, and a waste recess portion 40. As will be more fully described herein, the mounting surface 34 supports the razor blade 16 while the mounting holes 38 are provided to securely engage the protrusions 68 (to be described) of the upper body portion 18 to secure the same and the razor blade 16 to the lower body portion 14. The waste recess portion 40 is provided as an open receptacle for cut hair or other debris that may tend to dull or clog the razor blade 16 and which are to be discarded during the shaving process. The lower body portion 14 further comprises a leading surface 42 having a radius of curvature R1 which in the preferred embodiment is about 0.856 inches. The leading surface 42 further comprises a circumference or perimeter C1 a length W1, a rear edge 44, and a forward edge 46. The leading surface 42 is disposed forwardly from the cutting edge 54 (to be described) of the razor blade 16 so that any force applied by the user to the handle portion 12 is transmitted to the leading edge 42 and to the trailing edge 58 (to be described) rather than directly to the cutting edge 54 of the razor blade 16. The rear edge 44 of the leading surface 42 is disposed above the cutting edge 54. The leading surface 42 further comprises a plurality of notches or channels 48 disposed along the rear edge 44 and preferably evenly spaced. The notches or channels 48 are provided to straighten and/or prepare the hair of the skin prior to contact with the cutting edge 54 of the razor blade 16 and to allow cutting lubricants access to and to be present at the cutting edge 54 during contact of the skin with the cutting edge 54.

Figure 11:
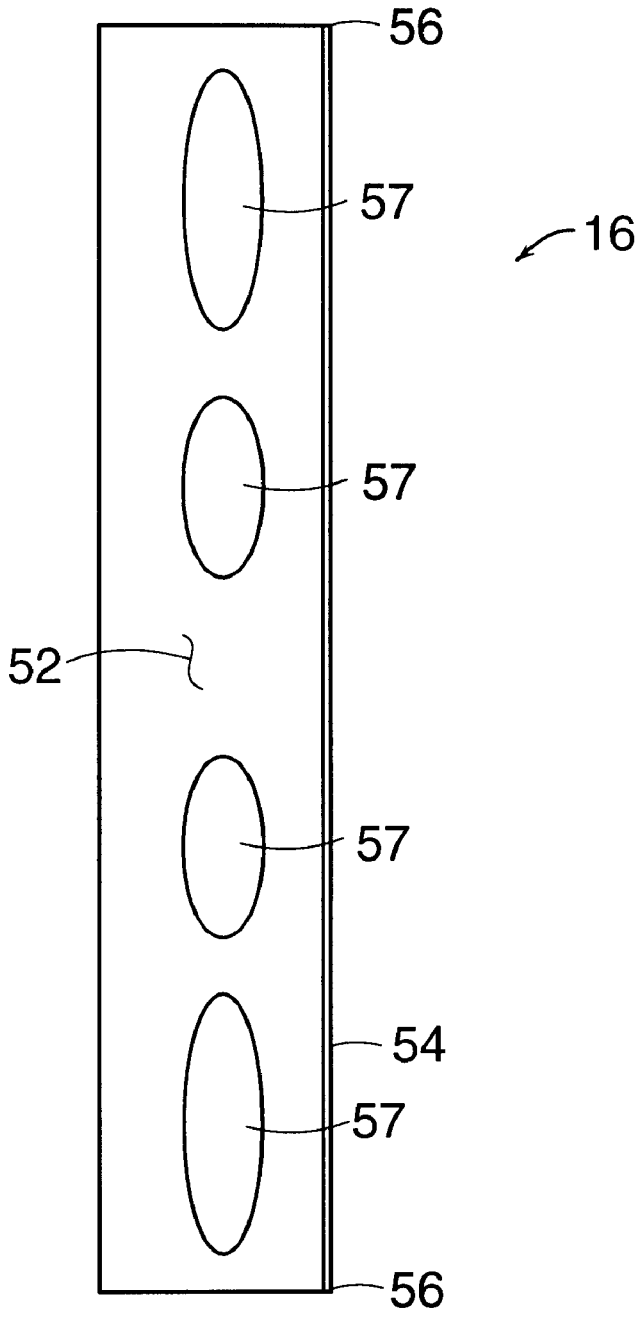
FIG. 11 is a plan view of the razor blade of the first embodiment.

Referring to FIGS. 1–4 and 11, the razor blade 16 generally comprises a planar surface 52 and a cutting edge 54. The cutting edge 54 terminates at sharp corners 56.The razor blade 16 further comprises a plurality of mounting holes or openings 57 which when assembly are in alignment with mounting holes 38 of the lower body portion to allow the protrusions 68 (to be described) of the upper body portion 18 to pass therethrough. Due to criticality of dimensions, the shaving device 10 is preferably formed with only a single razor blade 16. However, the shaving device 10 may be adapted for use with multiple razor blades 16. The razor blade 16 may be made from a variety of materials. In the preferred embodiment, the razor blade 16 is made from stainless steel or porcelain so as to be resistant to rusting and to reduce dulling of the cutting edge 54. Preferably, the razor blade 16 and the cutting edge 54 are cryogenically treated which results in a shaving blade more significantly more resistant to dulling that if the razor blade 16 were not cryogenically treated.

Figure 8:
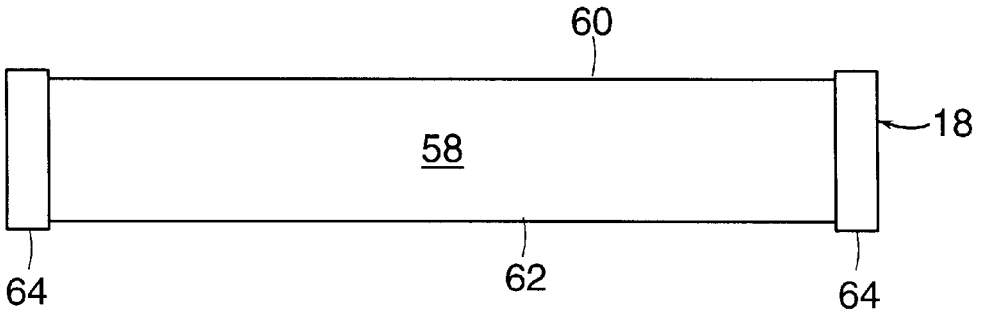
FIG. 8 is top plan view of the upper body portion of the first embodiment.
Figure 9:
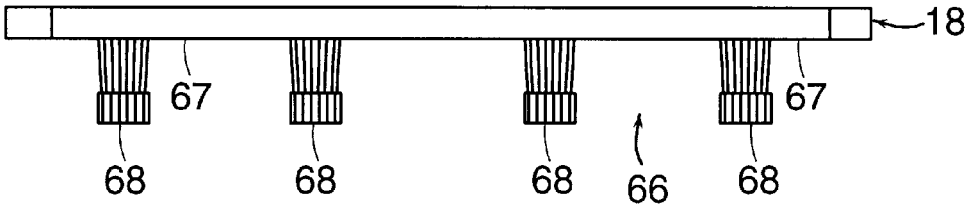
FIG. 9 is front elevation view of the upper body portion of the first embodiment.
Figure 10:
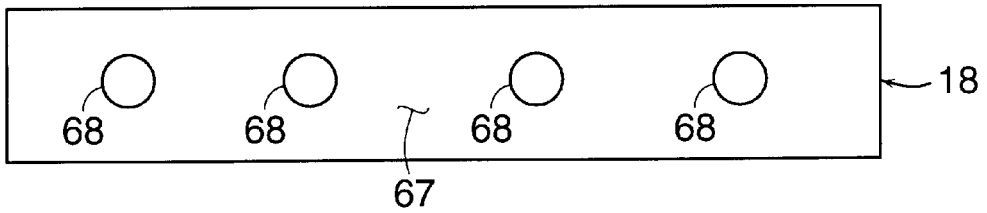
FIG. 10 is a bottom plan view of the upper body portion of the first embodiment.

Referring to FIGS. 1–4 and 8–10, the upper body portion 18 generally comprises a trailing surface 58 having a radius of curvature R2 which is preferably about 0.820 inches. The radius of curvature R1 of the leading surface 42 is slightly larger than the radius of curvature R2, of the trailing surface 58 to allow the skin to stretch and bulge into recess 50 (to be described) and over the trailing surface 58. The radius of curvature R1 of the leading surface 42 and the radius of curvature R2 of the trailing surface 58 may be of different dimensions so long as the radius R1 of the leading surface 42 is larger than the radius of curvature R2 of the trailing surface 58. Preferably, the leading edge 42 is about 0.006 inches above the cutting edge 54 of the razor blade 16. The upper body portion 18 further comprises a circumference of perimeter C2, a length W2, a rear edge 60, and a front edge 62. The trailing surface 58 is disposed upwardly from cutting edge 54 of the razor blade 16 so that any force applied by the user to the handle portion 12 is transmitted to the leading surface 42 and the trailing surface 58 rather than directly to the cutting edge 54 of the razor blade 16. The front edge 62 of the trailing surface 58 is disposed above the cutting edge 54. The upper body portion 18 further comprises a tab 64 located at each end of front edge 62 which is adapted to cover the sharp corners 56 of the cutting edge 54 when the shaving device 10 is assembled. The upper body portion 18 further comprises a lower mounting portion 66 having a mounting surface 67 and a plurality of protrusions 68 extending therefrom. Protrusions 68 are passed through openings 57 of the razor blade 16 and the mounting holes 38 of the lower body portion and then sonic melted to thereby secure the upper body portion 18 and razor blade 16 to the lower body portion 14 in a sandwich configuration.

Assembly of the upper body portion 18 and razor blade 16 upon the lower body portion 14 creates a recess or gap 50 between the leading surface 42 and the trailing surface 58 which provides access to the cutting edge 54 of the razor blade 16. The recess has a width W3. Width W3 or spacing of the gap 50 is critical and determines the allowable deflection of the skin into and preceeding the cutting edge 54 of the razor blade 16. Although it may of different dimensions, in the preferred embodiment the width or spacing W3 is preferably 0.080 inches or in the range of 0.050 inches to 0.120 inches. If the radial width or spacing W3 is too large, an excessive amount of skin will bulge into contact with the cutting edge 54 of the razor blade 16 and may result in nicking or cutting of the skin. If the width or spacing W3 is too small, the skin will not bulge into contact with the cutting edge 54 of the razor blade 16 and as such no shaving of the hair will result.

In operation, the leading surface 42 and the trailing surface 58 prevent any forces or pressure applied to cutting edge 54 of the razor blade 16 by the user from nicking or cutting the skin or irritation. The leading surface 42 and the trailing surface 58 absorb any forces applied to the device 10 (before such forces are transmitted to the cutting edge 54) by the person causing the skin to stretch and bulge into the recess portion 50 and to come in contact with the cutting edge 54 of the razor blade 16. The skin being pliable and having memory stretches and gently protrudes (bulges) into the recess portion 50 which is lower than the leading surface 42 and the trailing surface 54 and precisely pre-aligns itself to the cutting edge 54 of the razor blade 16 and also prevents the skin from passing under the razor blade 16.

The handle portion 12, lower body portion 14, and upper body portion 18 may be made from a variety materials and processes. By way of example only, the handle portion 12, lower body portion 14, and upper body portion 18 may be made from a high strength polymer material and manufactured by injection molding processes or metal alloys by machining, casting, or metal molding processes, or a combination thereof.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A device for shaving the skin of a person comprising:

(a) a handle member having a lower portion and an upper portion;

(b) a lower body member engaged with said upper portion of said handle member, said lower body member comprising a cavity portion and a leading surface, said leading surface having a front edge and a rear edge and a radius of curvature;

(c) a razor blade disposed within said cavity portion, said razor blade having a cutting edge and first and second corner portions;

(d) an upper body member having a lower mounting portion and a trailing surface, said trailing surface having a front edge and a rear edge and a radius of curvature, said lower mounting portion being adapted to secure said razor blade within said cavity portion, said trailing surface and said leading surface being spaced apart from said cutting edge of said razor blade; and (e) a recess portion separating said leading surface from said trailing surface and providing access to said cutting edge of said razor blade, whereby during shaving operations the leading surface and the trailing surface absorb any forces applied to the device by the person causing the skin to stretch and bulge into said recess portion and to come in contact with said cutting edge of said razor blade.

2. The device of claim 1, wherein said radius of curvature of said leading surface is larger than said radius of curvature of said trailing surface.

3. The device of claim 2, wherein said radius of curvature of said leading surface is about 0.856 inches and said radius of curvature of said trailing surface is about 0.820 inches.

4. The device of claim 2, wherein said recess portion has a width defined by the distance between said front edge of said trailing surface and said rear edge of said leading surface.

5. The device of claim 4, wherein said width of said recess portion is about 0.050 inches.

6. The device of claim 2, wherein said cutting edge of said razor blade comprises first and second corners, said lower mounting portion of said upper body member comprises a plurality of protrusions, said razor blade comprising a plurality of openings, and said cavity portion of said lower body member comprises a plurality of openings in alignment with said openings of said razor blade, said protrusions passing through said openings of said razor blade and said openings of said lower body member to secure the same.

7. The device of claim 6, wherein said trailing surface comprises first and second tab portions which cover said first and second corners of said cutting edge when said upper body member is engaged with said razor blade and said lower body member.

8. The device of claim 1, wherein said front edge of said trailing surface and said rear edge of said leading surface are each disposed above said cutting edge of said razor blade.

* * * * *